US009802440B2

(12) United States Patent
Lu

(10) Patent No.: US 9,802,440 B2
(45) Date of Patent: Oct. 31, 2017

(54) FOLDING ART WORK MOUNTING FRAME

(71) Applicant: Bin Lu, Saratoga, CA (US)

(72) Inventor: Bin Lu, Saratoga, CA (US)

( * ) Notice: Subject to any disclaimer, the term of this patent is extended or adjusted under 35 U.S.C. 154(b) by 0 days.

(21) Appl. No.: 14/978,792

(22) Filed: Dec. 22, 2015

(65) Prior Publication Data

US 2017/0173996 A1 Jun. 22, 2017

(51) Int. Cl.

| | |
|---|---|
| ***B44D 3/18*** | (2006.01) |
| ***D05C 1/02*** | (2006.01) |
| ***D06C 3/08*** | (2006.01) |

(52) U.S. Cl.

CPC ..... *B44D 3/185* (2013.01); *B44D 3/18* (2013.01); *D05C 1/02* (2013.01); *D06C 3/08* (2013.01)

(58) Field of Classification Search

CPC ..... B44D 3/185; B44D 3/18; D06F 59/08; D05C 1/02; B41F 15/34; B41F 15/36; D06C 2700/02; D06C 3/08; D05B 39/00; D05B 39/005; D05B 11/00

See application file for complete search history.

(56) References Cited

U.S. PATENT DOCUMENTS

| | | | | | |
|---|---|---|---|---|---|
| 721,749 | A * | 3/1903 | Sander | D06F 59/08 | 38/102.9 |
| 1,063,990 | A * | 6/1913 | McCoskey | D06F 59/08 | 38/102.9 |
| 3,482,343 | A * | 12/1969 | Hamu | B41F 15/36 | 101/127.1 |
| 4,271,619 | A | 6/1981 | Schmidt | | |
| 4,635,700 | A * | 1/1987 | Berger | B44D 3/185 | 160/374.1 |
| 4,949,483 | A | 8/1990 | Dobson | | |
| 4,991,328 | A | 2/1991 | Rousseau | | |
| 5,012,601 | A | 5/1991 | Garland | | |
| 5,483,779 | A * | 1/1996 | Crawford | G09F 15/00 | 135/151 |
| 5,704,164 | A * | 1/1998 | Huang | E06B 9/02 | 160/372 |
| 7,069,682 | B2 | 7/2006 | Gatt | | |
| 7,422,048 | B2 * | 9/2008 | Andersen | E06B 9/00 | 160/377 |
| 7,802,390 | B2 | 9/2010 | Reis | | |

FOREIGN PATENT DOCUMENTS

DE 2711618 A1 * 9/1978

* cited by examiner

*Primary Examiner* — Ismael Izaguirre
(74) *Attorney, Agent, or Firm* — Robert Brownstein

(57) ABSTRACT

The system invention herein disclosed and claimed is an art work frame that can easily be folded into a smaller area such that shipping container and costs are reduced. Upon arrival at its destination, it can easily be unfolded into frame suitable for art work mounting.

3 Claims, 8 Drawing Sheets

FOLDING ART WORK MOUNTING FRAME

This application repeats a substantial portion of prior application Ser. No. 14/738,900, filed on 2015 Jun. 14, and adds additional disclosure not presented in the prior application. Because this application names the inventor or at least one joint inventor named in the prior application, it may constitute a continuation-in-part of the prior application.

TECHNICAL FIELD

This invention is associated with frames used to mount art work media.

BACKGROUND OF THE INVENTION

For centuries, art work canvases have been mounted on wooden frames. When a framed canvas is to be shipped, the intact framed art work must be carefully packed with solid material and unpacked to avoid damage to the art work. Alternatively, the canvas is carefully removed, rolled up, and sent where upon arrival, a new frame is created and the art work carefully unrolled and mounted.

Today, art work can comprise paintings on canvas, photography on an assortment of flexible materials, and the like. Often, previously un-mounted art work is shipped and frames are provided at a destination for mounting.

In the mounting process, art work is carefully unrolled to prevent creases, and carefully centered on a frame. Excess canvas is then wrapped over each side of the frame and firmly attached to it with nails or staples. This mounting process usually requires professional skilled work with special tools. The resulting framed art work is sufficiently taut, centered and leveled.

BRIEF SUMMARY OF THE INVENTION

The invention herein disclosed and claimed is an art frame which is easily collapsed or expanded. It is used to quickly and easily mount art work previously prepared with sleeves on two opposite sides in which rod-like subsystems are inserted and used to anchor and tighten the art work during and after mounting. Mounting of art work can be a three-step process that may be done quickly with repeatable consistent results. In addition, art work may be fastened to the vertical portions of the frame, while fully extended. Prior to shipping, the frame is collapsed or folded and the art work is suitably gathered and protected. Upon arrival, the collapsed or folded frame is expanded or unfolded, and the art work is concurrently pulled taut. The top and bottom art work edges may then be fastened to the horizontal frame portions.

The rectangular frame comprises four interconnecting portions: an anchor portion; a tension portion; and two foldable side portions. The side portions, of equal length, are located on opposite sides of the frame; and the anchor and tension portions, of equal length, are located on opposite sides of the frame; forming a rectangular frame when expanded or unfolded.

When art work has been prepared for mounting on this frame, with sleeves formed on opposite sides, and rod structures inserted in the two sleeves, the art work is mounted by anchoring one sleeved end in the anchor portion of the frame, and the opposite sleeved end in the tension portion of the frame. An adjustable tension subsystem applies tension to the rod and pulls the art work taut. Other mechanisms, such as a ratcheting or spring-tension roller structure, could also be used to apply tension to the end of the art work. Excess material overlapping the frame side portions is folded over the portions and affixed with a reversible adhesive, such as a contact cement-like coating or hook-and-loop type fastening. This allows the art work to be easily removed, and shipped, later.

The rod-like subsystem used for the anchored side has a cross-section profile having two different orthogonal dimensions, such as an elliptical cross-section with a first diameter larger than a second diameter which is orthogonal to the first. The elliptical shape enables the ends of that rod to be inserted in the anchor portion slot and rotated essentially 90 degrees, locking the ends into the slot and preventing the rod from dislodging when tension is applied to it. The term "elliptical profile" means any profile having different orthogonal dimensions operative to lock the ends of the rod in their respective anchor portion slot once the rod has been rotated essentially 90 degrees.

Art frames, when collapsed or folded can be conveniently shipped along with art work; or art frames on hand at the destination can be quickly expanded or unfolded and used to mount received art work.

BRIEF DESCRIPTIONS OF THE DRAWINGS

DETAILED DESCRIPTION OF THE INVENTION

For centuries, paintings have been done on canvas and later mounted to wooden frames for display. Today, art work can consist of paintings, drawings, ink jet and laser printing of illustrations and digital images on a variety of materials comprising canvas, plastics, and other flexible media. Often, these art works are mounted on frames for display, too.

In our global economy, it is common for art work done in one country to be shipped internationally for mounting and sale in another country. Shipping mounted art works requires meticulous preparation from preparing and packing to unpacking, in order to avoid damage. In addition, it takes up more container space during transportation resulting in increased shipping costs.

Sometimes, art work is rolled up, placed inside a protective cylindrical container, and shipped. Upon arrival, it is unrolled, carefully, and mounted on a frame usually on hand at the final receiving location.

Figure 1:
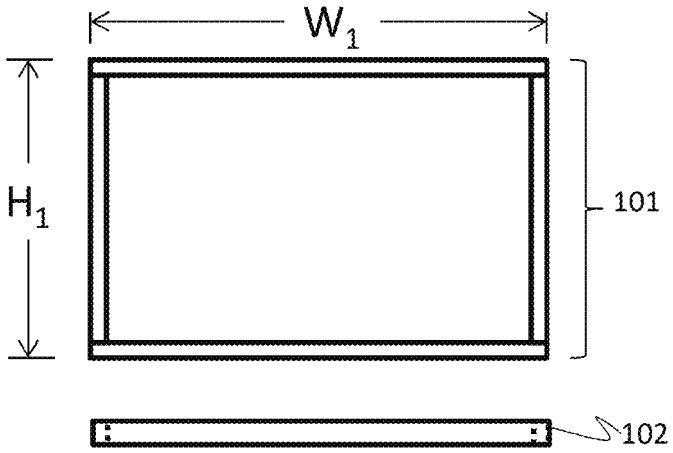
Prior Art Fig. 1
FIG. 1 depicts a conventional art frame. It is prior art

As shown in FIG. 1, a typical art frame consists of four portions forming a rectangular structure with opposite, equal dimensions, for example, $W_1$ and $H_1$. A variety of methods can be used for assembling the four frame portions into a single, rigid frame.

Figure 2:
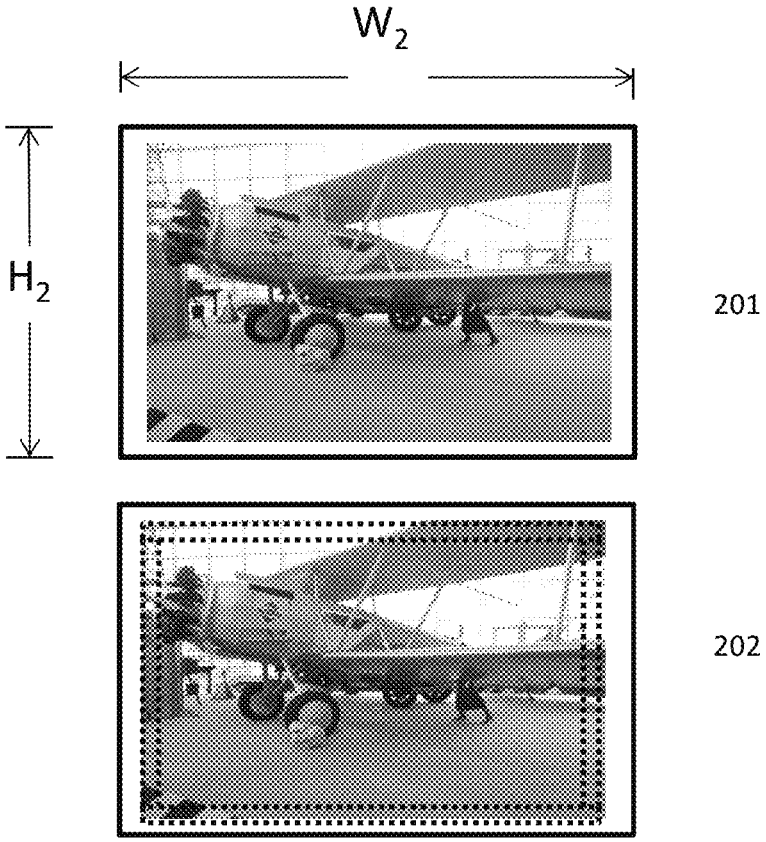
Prior Art Fig. 2
FIG. 2 depicts a piece of art work being mounted to a conventional art frame. This is prior art.

As shown in FIG. 2, a rectangular-shaped art work could be mounted on the conventional frame. The overall dimensions of the art work medium would be larger both in width and height to that of the intended mounting frame (201), where the art work's dimensions are $W_2$ and $H_2$, and $W_2>W_1$ and $H_2>H_1$. The frame's outer dimensions would coincide with the art work images width and height, that is, $W_1$ and $H_1$ (202)

Figure 3:
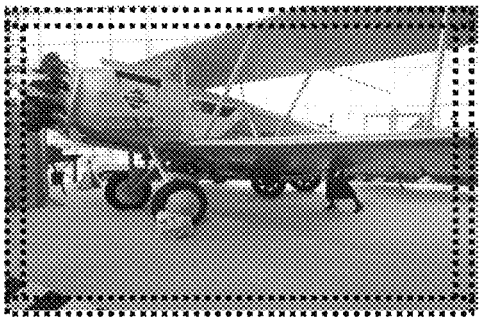
Fig. 3 Prior Art
FIG. 3 depicts a fully mounted art work on a conventional frame. This is prior art.

With the art work image centered on the frame, the excess material would be folded over each underlying frame portion. Stretched by force using special tools and nailed or stapled to the frame, the resulting mounted art work is depicted in FIG. 3.

Figure 4:
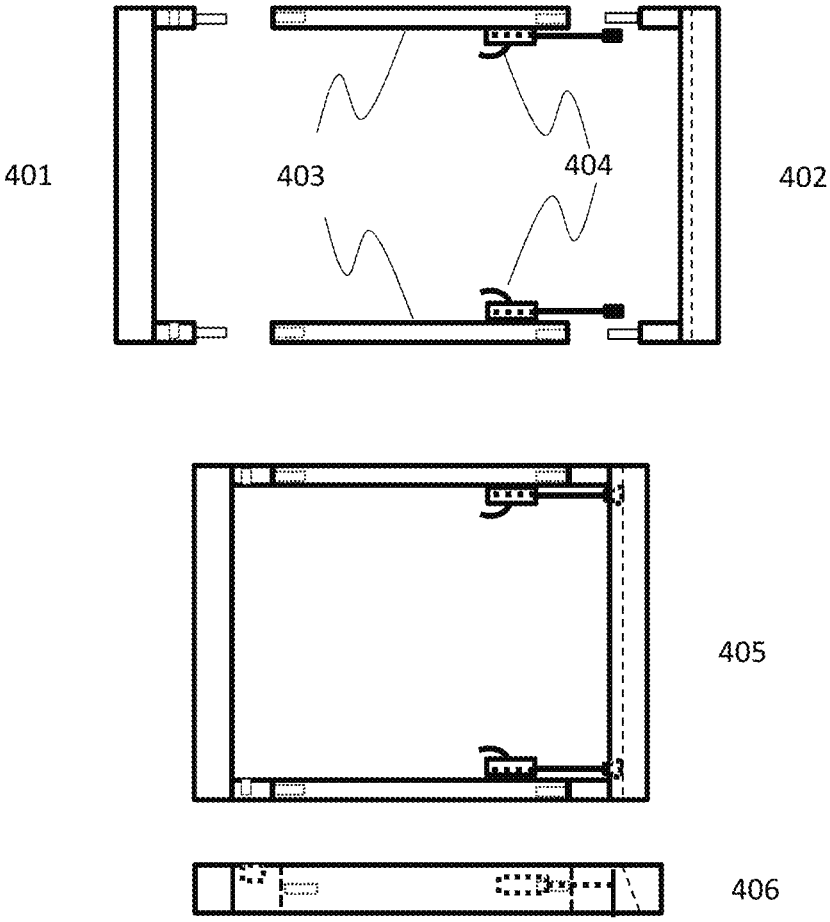
FIG. 4 illustrates a fixed art frame kit prior to assembly.
Figure 5:
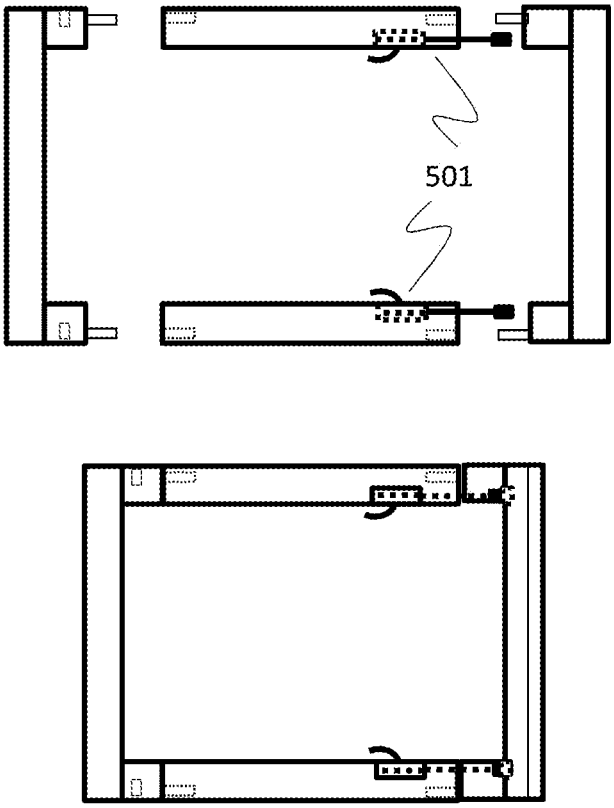
FIG. 5 illustrates another embodiment of a fixed art frame kit prior to assembly.

A fixed art frame, comprised of separate parts, is exemplified by FIG. 4. An anchor portion, 401, and a tension portion, 402, attach to two side portions, 403, using any well known in the art means of such. For example, one portion has a protruding dowel rod and the side to which it is attached has a cylindrical hole whose dimensions provide a snug fit. When the art work is pulled to make it taut this end of rod will not leave the cylindrical hole. Also shown is an adjustable tension subsystem, 404. The adjustable tension subsystem can be positioned as shown in FIG. 4, or as shown in FIG. 5. The positioning is not critical so long as the adjustable tension subsystem can apply the required tension on a rod-like structure. Alternative mechanism for keeping the art work taut could include a roller, oriented vertically, with a ratcheting or sprint-tension fixture that rolls up the non-anchored end of the art work and either locks it at a discrete tension point corresponding to a ratchet position, or applies constant spring tension to keep the art work taut.

Figure 6:
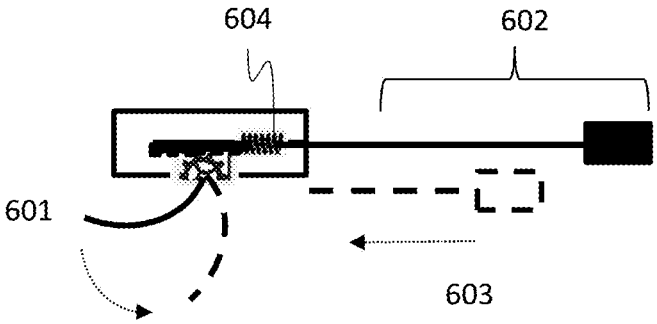
FIG. 6 illustrates a more detailed view of an embodiment of a tensioning subsystem.

FIG. 6 shows an embodiment of the adjustable tension subsystem. A piston-like substructure (602) is used to apply pressure to art work material when 602 is extended. An actuating subsystem (601) can be manipulated such that it is operative to increase or decrease the tension applied, and can be locked in intermediate tension positions. For example, as shown by the solid line, 601 would cause 602, shown in solid line, to extend and increase tension. When 601 is moved to the dotted-line position, it would partially retract 602 in the direction shown by 603. This would decrease tension. A coil-spring like substructure (604) is part of the rod structure. It could prevent excess pressure being applied to the art work material, and it can compensate for increased slack if the art work medium expands. The actuating subsystem may be implemented such that a locking detent acts as a ratcheting subsystem locking the actuator gear in each new position until advanced to the next position. This would keep tension applied as the adjustable tension subsystem is incrementally increased in tension. Other means for locking the actuator during incremental adjustment may also be implemented.

Figure 7:
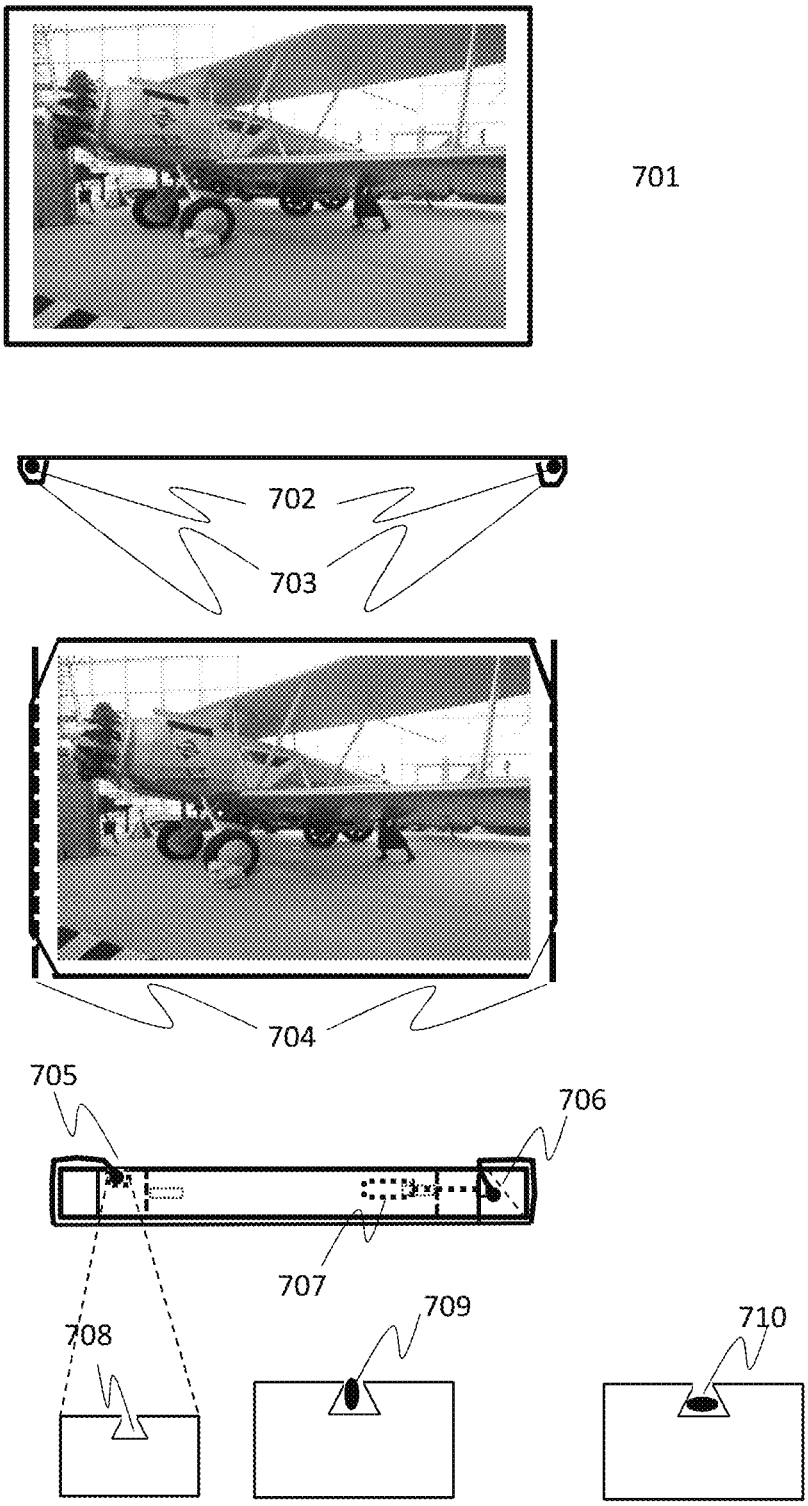
FIG. 7 illustrates how art work is prepared for mounting, and shows how the art work is then mounted on the art frame.

As shown in FIG. 7, a suitably prepared art work can be mounted on this art frame with just a few steps. The original art work is rectangular (701). Portions of the corners are removed and sleeves are formed on each side (703). Rod-like subsystems are inserted through the sleeves on each side (702). A front-facing view shows the cut corners, sleeves and rods inserted (704). Note that on the anchor portion ends, there are anchoring slots cut into the portion where an opening is slightly larger than a rod's elliptical-profile end's smaller diameter and the slot widens into cavity (708). When the art work side's rod is inserted into each anchoring slot, the rod is rotated such that the thinner dimension will allow it to pass into the anchoring slot (709). Once it has been passed through, the rod is rotated such that the larger dimension is now parallel to the anchoring slot opening (710). In that position, the rod is effectively locked in place and cannot be pulled up and out. Although the cross-section of the rod is herein described as elliptical, it can be other shapes having differing cross-sectional dimensions, for example, a rectangular shape.

The method for mounting the art work comprises preparing the art work, for example, cutting material off the corners, and forming the sleeves in each end. During mounting, rod-like structures are inserted through each sleeve. Once the art work is prepared for mounting, one places the back side of the art work against the frame's four portions, folds one of the art work's sleeved ends around the anchor portion and inserts one end of the rod into one anchor point and the other end into the other anchor point. The rod is rotated until it passes through the anchoring slot (FIG. 7, 709), then rotated into the locked position (FIG. 7, 710). The other sleeved side and its rod are folded underneath the tension portion, along the slanted surface (FIG. 7, 706). While holding the rod in that position, the adjustable tension actuator is manipulated so as to push the piston against the art work material such that the rod is trapped in that position. Further movement of the actuator will increase tension against the rod and art work material essentially making the material taut and flush against the frame. The adjustable tension subsystem's actuator, locking after each incremental adjustment, remains locked in the last position. Any excess art work material extending over the top portion is folded over that portion and affixed to the top portion of the frame by reversible adhesive means, such as contact cement or hook-and-loop fastening; any excess art work material extending over the bottom portion is folded over that portion and affixed to the bottom portion of the frame with reversible adhesive means. The art work material at the corners may be scored so as to make the final steps easier and more precise. One alternative way of mounting the art work would be to have one end anchored on the anchor portion, and the art work rolled up around that anchor portion. When ready to be assembled and mounted, the art work on the anchored portion is unrolled and the opposite end is prepared for attachment to the tension portion.

By using different side portions for the art frame, one can pre-assemble the frame, then collapse or fold it for transport without having to first disassemble it and later reassemble it. This further reduces the time and complexity of shipping and mounting art works and frames. In addition, one may attach the vertical edges of the art work to the vertical portions of the foldable frame while it is fully extended. The art work can be adjusted at that time for proper tautness. Afterward, the frame is collapsed or folded, and the now loosened art work is gathered and protected for shipping. Upon arrival at a destination, the frame is again fully extended which serves to pull the pre-attached art work taut.

At that time, the top and bottom edges of the art work may be affixed to the horizontal portions of the folding frame.

Figure 8:
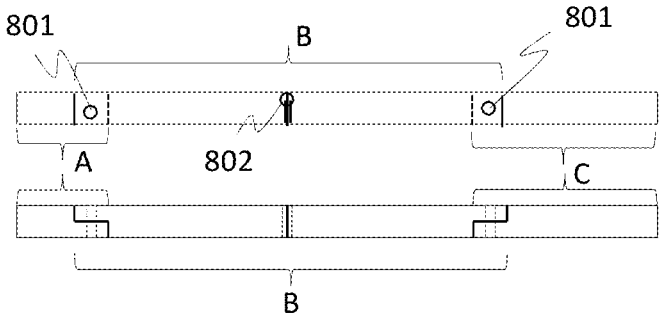
FIG. 8 illustrates the side structure portion of the invention art frame.

FIG. 8 shows a folding side portion comprising a short side end substructure (A), a long side end substructure (C), and a folding substructure (B). A complete folding side structure comprises folding substructure B attached at one end to short side end substructure A and at the other end to long side substructure C by using a pivot interface 801. The pivot interface is essentially a hole through, say, short side end A that lines up with a hole in one end of the folding substructure through which a pivoting fixture is installed. This will allow that end of the folding substructure to pivot with respect to short side end A. Similarly, the other end of folding substructure B has a hole that lines up a hole in long side end C. Here, again, a pivoting fixture is installed allowing that end of the folding substructure to pivot with respect to long side end C. The pivoting mechanism may be such that it only allows pivoting when folding and prevents further pivoting when fully expanded. Note that the folding substructure's two equal-length elements are connected to a hinging mechanism (802). Alternatively, in place of a pivoting mechanism (801) that joins the folding substructure to the short side end substructure and the long side end substructure, one may use a hinging fixture, such as 802, which allows the rotation but locks the pieces into a rigid, fixed position when fully unfolded.

Figure 9:
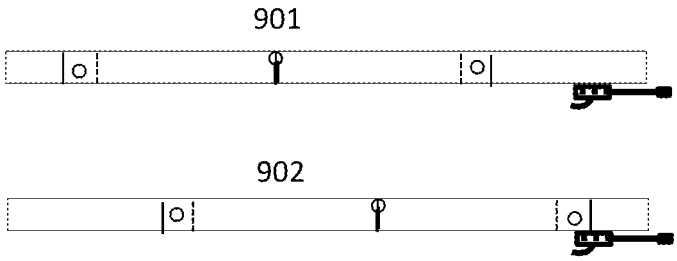
FIG. 9 illustrates another embodiment of the side structure.

FIG. 9 shows a top and side view of the embodiment using hinging mechanisms in place of the pivoting mechanisms.

When the frame is folded, the folding substructures of the two side portions will each fold in toward one another. Because of the asymmetry established by the non-equal dimensions of the short side end and long side end substructures, the folding substructures are displaced from one another so long as the side structures are assembled such that a short side end of one folding substructure is oriented opposite a long side end of the other folding substructure.

Figure 10:
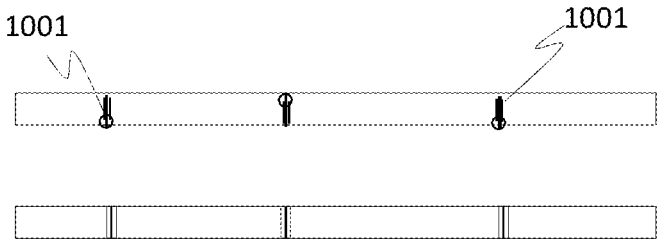
FIG. 10 illustrates the difference between a top and bottom folding side structure configuration.

In FIG. 10, the configuration of top side portion 901 has the short side end substructure located on the left and the long side end substructure located on the right. The bottom side portion 902 has the long side end substructure located on the left and the short side end substructure located on the right. The tension apparatus is shown attached to the long side end substructure on 901 and the short end side substructure on 902. Note that this configuration is arbitrary. That is, 901's short side end could be on the right, and the long side end could be on the left so long as 902's short side end is on the left and the long side end on the right.

Figure 11:
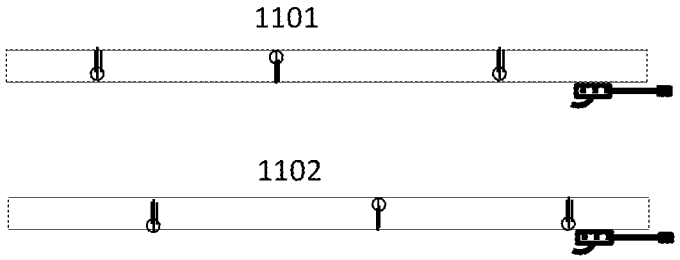
FIG. 11 illustrates the different between a top and bottom folding side structure for the embodiment of FIG. 9.

FIG. 11 illustrates the same asymmetrical top and bottom side portions using the embodiment of FIG. 9.

Figure 12:
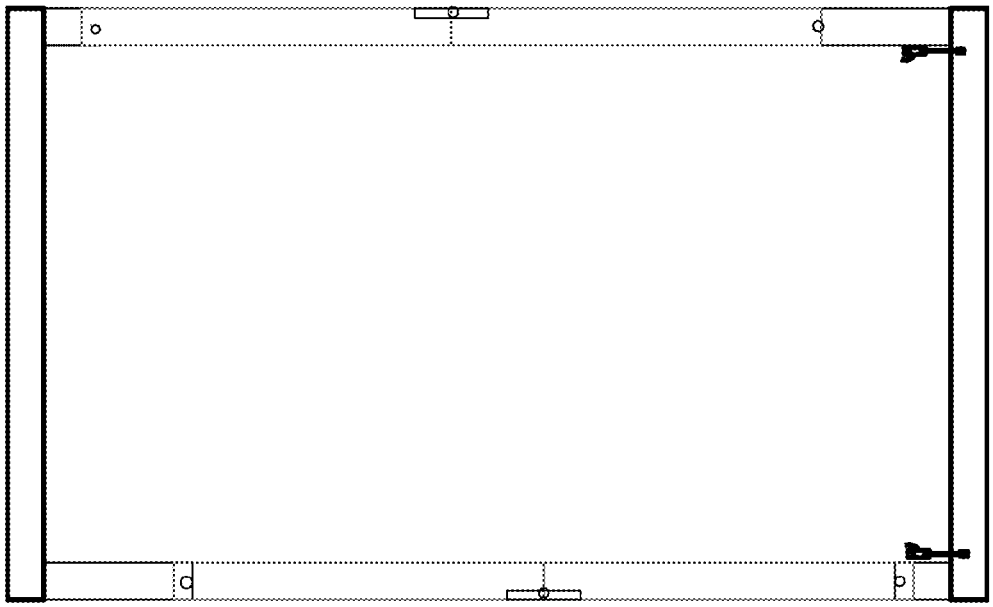
FIG. 12 shows the complete frame with anchor portion, tension portion, top side portion and bottom side portion in fully extended or unfolded state.

A fully extended or unfolded frame is shown in FIG. 12. Note that the side portion that corresponds to 901 in FIG. 9 is located at the top of the invention frame; and the side portion that corresponds to 902 in FIG. 9 is located at the bottom of the invention frame. The tension apparatus on each is adjacent to the tension portion of the frame.

Figure 13:
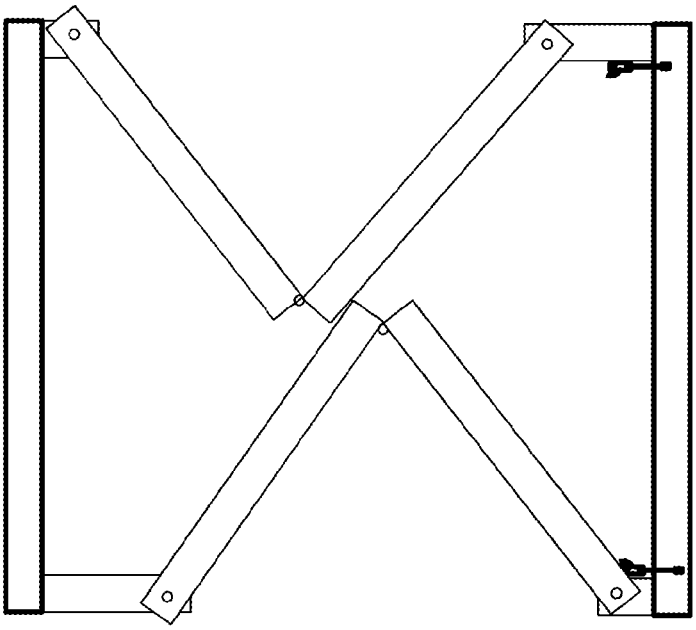
FIG. 13 illustrates a partially folded or collapsed invention frame.

In FIG. 13, the frame is partially collapsed or folded. Note that the asymmetry allows the hinged ends of the folding substructures to approach one another but are displaced from one another.

Figure 14:
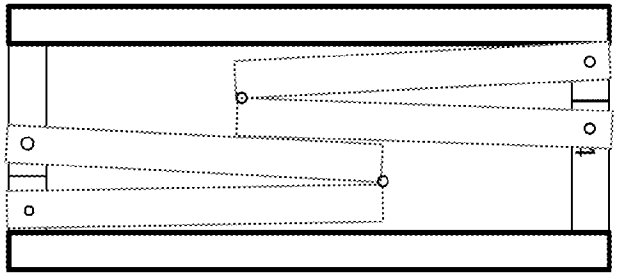
FIG. 14 shows the fully folded or collapsed invention frame.

In FIG. 14, the fully collapsed or folded frame is shown. Note that the folding substructures line up to the side of one another allowing the anchor and tension portion to be parallel to and close to one another reducing the frame area commensurately and thereby reducing the container volume required to transport it.

Figure 15:
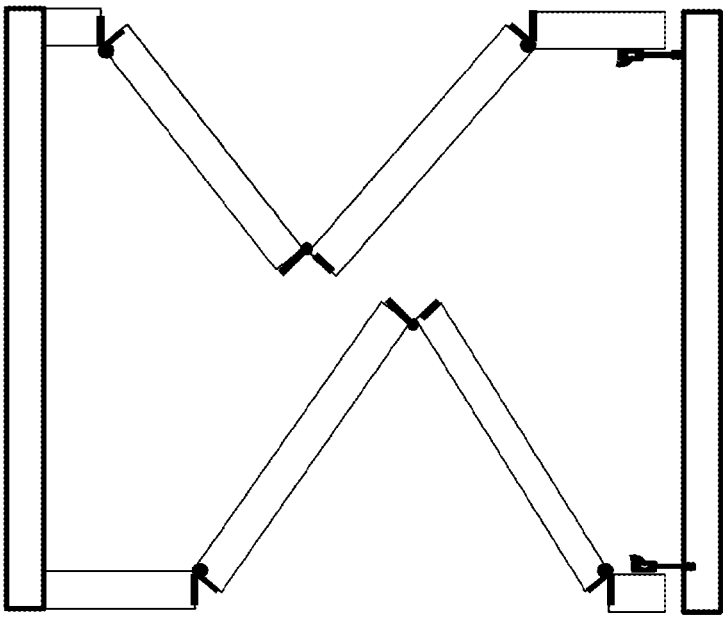
FIG. 15 shows a partially folded or collapsed invention frame based on the embodiment of FIG. 9.

FIG. 15 shows a partially folded illustration of the frame with embodiment shown in FIG. 9.

Note that whereas the illustrations and example describe an art frame suitable for, say, wall mounting; the folding art frame could be increased in size to accommodate larger art works, such as posters, and used as collapsible walls of an exhibit booth. This would allow such a booth to be shipped with pre-assembled, folded, walls that can be expanded, allowing for rapid art work mounting, and joined together to form the side of the exhibition booth.

An art work, as defined herein, is any image that is painted on, printed on, flecked onto, or otherwise imprinted on one side of a sheet of art work medium. Art work medium is defined, herein, as a sheet of material, sufficiently flexible so as to be rolled up.

The art work to be mounted on the art frame will have sleeves on two opposite sides that coincide with the kit's rod-like subsystems. In addition, the art work will have a reversible adhesive coating, such as a contact cement layer, or one strip of a hook-and-loop fastener. The art frame kit's side portions will be fitted with the mating strip of a hook-and-loop fastener, if that method of attachment is chosen. Other types of reversible adhesive means may also be employed.

The anchor portion, tension portion and side portions of the art frame can be made of wood, metal, and any other material with sufficient rigidity to serve as an art work frame.

The anchor portion of the art work frame is defined, herein, as that portion of the art frame to which one side of the art work will be anchored into position.

The tension portion of the art work frame is defined, herein, as that portion of the art frame to which one side of the art work will be inserted and upon which tension will be applied so as to pull the art frame material taut. The tension portion will also allow tension to be released so as to facilitate removing a mounted art work.

The side portion of the art work frame is defined, herein, as that portion of the art frame typically located at the top and bottom of the art frame, which provides a means of joining one end of the anchor portion and one end of the tension portion to its opposite ends, and comprises an adjustable tension subsystem operative to apply adjustable tension to one side of the art work material.

As previously noted, the side portions may also have mating strips for hook-and-loop fastening.

Note that all drawings are exemplary and should not be viewed as limiting the scope of this invention.

What is claimed is:

1. An art work frame comprising:

an anchor portion of predetermined dimension;

a tension portion of predetermined dimension;

a first side foldable portion of predetermined dimension;

a second side foldable portion of predetermined dimension;

said anchor portion and said tension portion are oriented essentially parallel to one another forming opposite vertical sides of said art frame;

said first side foldable portion and said second side foldable portion are oriented essentially parallel to one another, when unfolded, forming opposite horizontal sides of said art frame;

said first side foldable portion and said second side foldable portion each comprising a short side end substructure, a folding substructure, and a long side end substructure arranged in that order;

said folding substructure comprising two sections of equal length joined together at one end of each by a hinging mechanism; the other ends of each section support attachment via a pivoting interface;

said short side end substructure supports attachment via said pivoting interface to said folding substructure, and supports fixed attachment to one end of a vertical frame portion;

said long side end substructure supports attachment via said pivoting interface to said folding substructure, and supports fixed attachment to one end of said vertical frame portion;

said pivoting interface operative to allow pivoting of said folding substructure when being folded but prevents further pivoting of the said folding substructure when fully extended;

said folding substructure comprising two sections of equal length joined together at one end of each by a hinging mechanism; the other ends of each section support attachment via said hinging mechanism;

said short side end substructure supports attachment via said hinging mechanism to said folding substructure, and supports fixed attachment to one end of said vertical frame portion;

said long side end substructure supports attachment via said hinging mechanism to said folding substructure, and supports fixed attachment to one end of said vertical frame portion.

2. A claim as in claim 1 further comprising:

said first side foldable portion having one said end of its said short side end substructure attached to a top end of said anchor portion and one said end of its said long side end substructure attached to said top end of said tension portion; with the said hinging mechanism that joins said sections of said folding substructure oriented so as to have an apex of an angle formed by folding of said folding substructure moving in a downward direction;

said second side foldable portion having one said end of its said long side end substructure attached to a bottom end of said anchor portion and one said end of its said short side end substructure attached to said bottom end of said tension portion; with said hinging mechanism that joins said sections of said folding substructure oriented so as to have said apex of said angle formed by the folding of said folding substructure moving in an upward direction.

3. A claim as in claim 1 further comprising:

said first side foldable portion having one said end of its said short side end substructure attached to said top end of said tension portion and one said end of its said long side end substructure attached to said top end of said anchor portion; with said hinging mechanism that joins said sections of said folding substructure oriented so as to have said apex of said angle formed by folding of said folding substructure moving in said downward direction;

said second side foldable portion having one said end of its said long side end substructure attached to said bottom end of said tension portion and one said end of its said short side end substructure attached to said bottom end of said anchor portion; with said hinging mechanism that joins said sections of said folding substructure oriented so as to have said apex of said angle formed by folding of said folding substructure moving in said upward direction.

* * * * *